United States Patent [19]

Glover

[11] 4,068,433

[45] Jan. 17, 1978

[54] WOOD-FRAME GLASS DOOR UNIT

[76] Inventor: J. Raymond Glover, Rt. 1 Box 336, Mt. Pleasant, Tex. 75455

[21] Appl. No.: 683,718

[22] Filed: May 6, 1976

[51] Int. Cl.[2] ..... E06B 1/04; E04C 2/00

[52] U.S. Cl. ..... 52/207; 52/631

[58] Field of Search ..... 52/207, 631, 642; 49/501, 504

[56] References Cited

U.S. PATENT DOCUMENTS

| | | | |
|---|---|---|---|
| 1,450,733 | 4/1923 | Reaugh | 49/504 |
| 2,571,696 | 10/1951 | Embury | 52/631 |
| 2,611,933 | 9/1952 | Comfort | 52/207 |
| 2,953,824 | 9/1960 | Minick | 52/207 |
| 3,406,485 | 10/1968 | Ovens | 49/504 |
| 3,436,884 | 4/1969 | Bell et al. | 49/504 X |
| 3,774,360 | 11/1973 | Hubbard et al. | 52/207 X |
| 3,802,127 | 4/1974 | Silvernail | 49/504 X |

FOREIGN PATENT DOCUMENTS

| | | | |
|---|---|---|---|
| 601,708 | 5/1948 | United Kingdom | 52/207 |

*Primary Examiner*—J. Karl Bell

*Attorney, Agent, or Firm*—Richards, Harris & Medlock

[57] ABSTRACT

The specification discloses an improved wood-frame glass door unit which includes a surround structure with at least two wood-frame door panels mounted within the surround structure. Each door panel includes a frame having a horizontal top rail and bottom rail maintained in a spaced relation by left and right side rails. The rails are composed of laminated wood strips which permits substantial reduction in the width of the rails and a greater glass to frame ratio. A glass pane is fitted within each frame. One door panel is fastened to the surround structure by a plurality of fasteners passing through the surround structure into the top and bottom rails and one of the side rails of the fixed panel. Angle brackets attach the opposite side rail of the fixed door panel to the surround structure. A mullion is attached to one of the side rails of the frame of the fixed door panel to add further support. The second door panel is hingedly connected to the fixed door panel adjacent the mullion such that the hingable door panel hinges against the adjacent fixed door panel.

21 Claims, 13 Drawing Figures

WOOD-FRAME GLASS DOOR UNIT

FIELD OF THE INVENTION

This invention relates to wood-frame glass doors and more particularly to hinged wood-frame glass doors.

PRIOR ART

A large portion of glass doors now in use in the construction of homes and buildings are of the sliding aluminum-frame glass door variety. These doors have experienced a degree of success, in part resulting from the relatively light weight of the aluminum frame and the narrowness of the frame relative to the glass supported therein. The sliding aluminum-frame glass doors have, however, been plagued by numerous problems when compared to conventional hinged wood-frame glass doors. The structure permitting one panel of a two-panel door to slide open and closed has been a source of many of these problems. Because of the sliding action, the rollers and track on which the rollers move are subjected to constant contact resulting in continuous wear and breakage. Additionally, the adjustment of the door and rollers relative to the track has been a source of substantial problems with proper adjustment being difficult but necessary for acceptable operation of the door.

The proper operation of the sliding aluminum-frame glass doors is also more severely affected by the slight shifting of the surround structure, as caused by settling, than the hinged type door. Additionally, because this type of door slides within its surround structure rather than is hinged thereto, insulation of the door to the surround structure to form a positive seal is more difficult.

There are also substantial disadvantages to the use of aluminum over wood-frame glass doors. The aluminum-frame glass doors experience substantial "sweating" where the temperature differential between the inside and outside of the door varies to any degree. Moreover, aluminum has much greater heat conduction properties and thereby serves as a less efficient heat insulator than wood-frame doors. Further, the sliding aluminum-frame glass doors cannot be as positively secured as a hinged type door due to the relationship of the door and surround structure as a result of the sliding arrangement.

On the other hand, the conventional wood-frame glass doors, while avoiding many of the problems suffered by the aluminum-frame glass doors, also incorporate many undesirable features. Conventionally, the wood-frame glass doors have required wider and heavier frame structures than in the aluminum frame doors thereby reducing the glass area permitted in the overall door. This naturally limits the openness effect achieved by the larger glass-to-frame ratio. While the conventional wood-frame glass doors have offered all of the advantages associated with the use of wood over aluminum sliding doors, such as better sealing with the surround structure, the elimination of "sweating", and the elimination of structure necessary to accomplish the sliding of one panel relative to another, and repairs such structure frequently requires, the wood-frame glass doors have conventionally been hinged from the surround frame structure. This geometry has created problems in that the hinged door opens onto the adjacent wall thereby restricting the use of that wall for light switches, drapery pulls, or in the arrangement of furniture in the room. Thus, a need has arisen for a new concept in glass door units which incorporates both the functional and aesthetic features found in wood-frame glass doors while eliminating the problems associated with such door units. At the same time, the new door unit should incorporate the beneficial feature of an increased glass-to-frame ratio found in aluminum-frame doors without incorporating the numerous disadvantages heretofore experienced in the use of such doors.

SUMMARY OF THE INVENTION

The present invention discloses an improved wood-frame glass door unit which overcomes the deficiencies heretofore experienced by the prior art aluminum and wood-frame glass door units. In accordance with one embodiment of the invention, the wood-frame glass door unit includes a wood surround structure which is attached to the structure of the home or building in which the door unit is to be installed. At least two wood-frame door panels are mounted within the surround structure. Each door panel includes a frame having a horizontal top rail and bottom rail maintained in a spaced parallel relation by left and right side rails. The rails are composed of edge glued wood strips formed from high quality wood stock thus forming a laminant structure with higher strength properties than a single wood member. Because the laminated rails have more strength per cross-sectional area than a single wood member, the rails of the wood frame of the present invention are substantially reduced in width thereby permitting a greater glass to frame ratio than prior art structures. Additionally, the composite door panel is relatively lighter than conventional wood-frame door panels. A glass pane is fitted within each frame and one of the door units is rigidly mounted to the surround structure. The second door panel is hingedly connected to the fixed door panel such that the hingable door panel hinges against the adjacent door panel. The hinging of the one door panel from the other is in part made possible by the narrower and therefore lighter weight frame resulting from the laminated structure from which the frame is constructed.

In accordance with one embodiment of the invention, the surround structure includes a first and second side door jamb and a top and bottom frame member attached between the top and bottom ends of the side door jambs, respectively. The fixed door panel is fastened to the surround structure by a plurality of screws passing through the top and bottom frame members into the top and bottom rails and through one of the side door jambs into the adjacent side rail of the fixed panel. Angle brackets attach the opposite side rail of the fixed door panel to the top and bottom frame member.

In accordance with still another aspect of the invention, additional support is furnished to the fixed door panel by rigidly attaching a mullion to the side rail of the frame of the fixed door panel adjacent the hinged door panel. The mullion support provides rigidity to the fixed door panel adjacent the point from which the hinged door panel is attached.

In accordance with still another aspect of the invention, the glass panel may be an insulated glass unit including two glass panes separated by a predetermined distance when installed in the door frame structure.

In accordance with still another aspect of the invention, a sliding screen door is adapted to slide relative to the surround structure such that the screen door slides to close over the section of the surround structure opened when the hingable door unit is hinged open and wherein the sliding screen door opens by sliding adjacent to the fixed door panel.

DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENT

Figure 1:
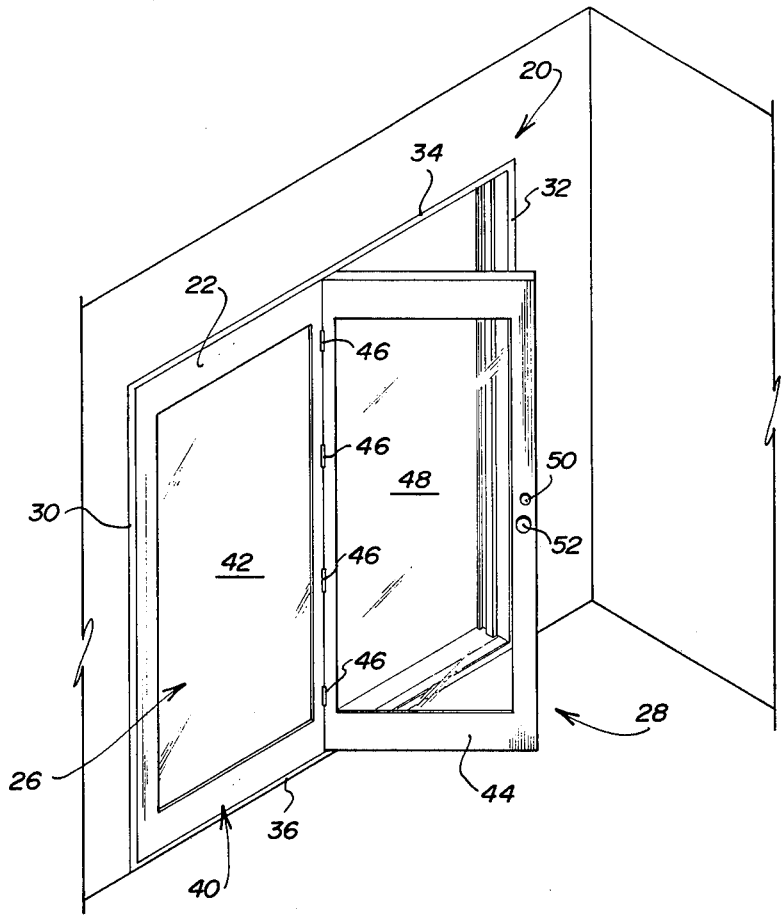
FIG. 1 is a perspective view of the door unit of the present invention as seen from the inside.

FIG. 1 is a perspective view of a door unit 20 embodying the present invention as viewed from inside the structure in which the unit is installed. Door unit 20 includes a surround structure 22 attached to a wall 24 of the structure in which the door unit is installed and two door panels 26 and 28 which are fitted to surround structure 22. Door surround structure 22 includes left and right door jambs 30 and 32, respectively, an upper jamb 34 and lower sill 36. The left, right and upper door jambs and lower sill are attached to the structure of wall 24 (not shown) by the conventional methods such as nailing or bolting.

Door panel 26 is a fixed panel including a wood-frame 40 rigidly attached to surround structure 22 as will hereinafter be discussed in greater detail. Frame 40 of door panel 26 is fitted with a glass pane 42. Door panel 28 includes a wood-frame 44 which is hinged from door panel 26 by hinges 46. Frame 44 of panel 28 is fitted with a glass pane 48. Door panel 28 further includes a lock assembly 50 and door knob assembly 52 which operate to lock and latch hingable door panel 28 to right door jamb 32 in a conventional manner.

Figure 2:
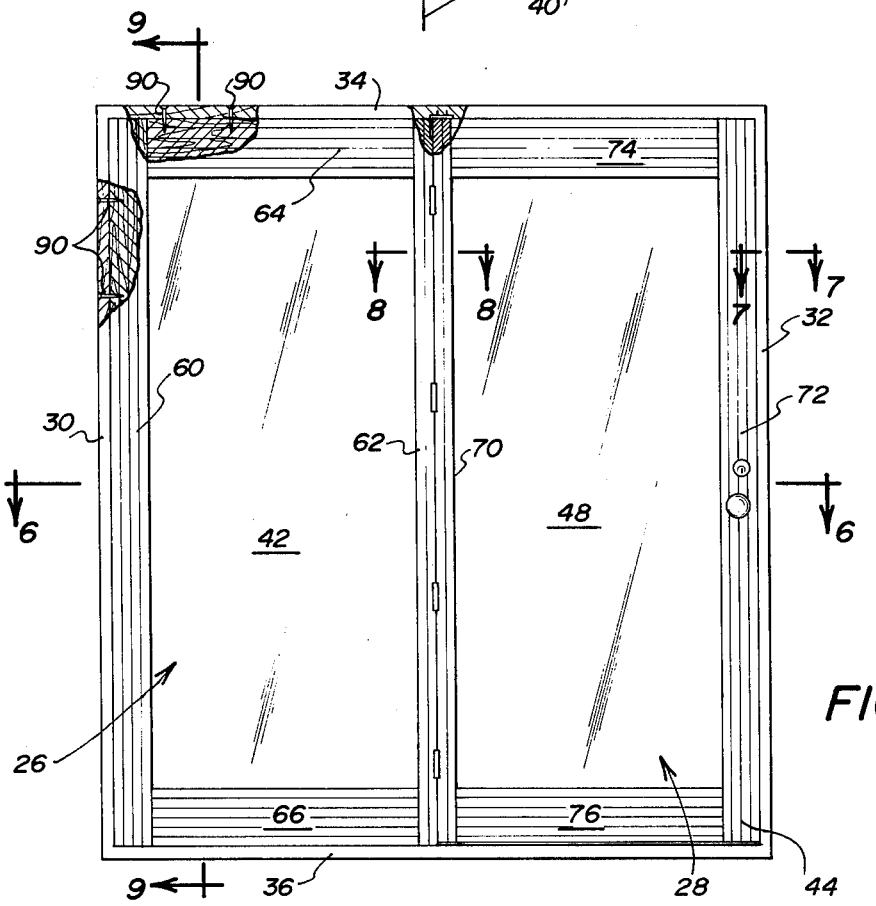
FIG. 2 is a front elevational view of a preferred embodiment of a door unit of the present invention.

Referring now to FIG. 2, frame 40 of fixed panel 26 includes a pair of vertical left and right rails 60 and 62, respectively. Rails 60 and 62 are maintained in a spaced parallel relationship by upper and lower rails 64 and 66, respectively. Frame 44 of door panel 28 is likewise comprised of left and right vertical rail members 70 and 72, respectively, maintained in a spaced parallel relation by upper and lower rails 74 and 76.

Figure 3:
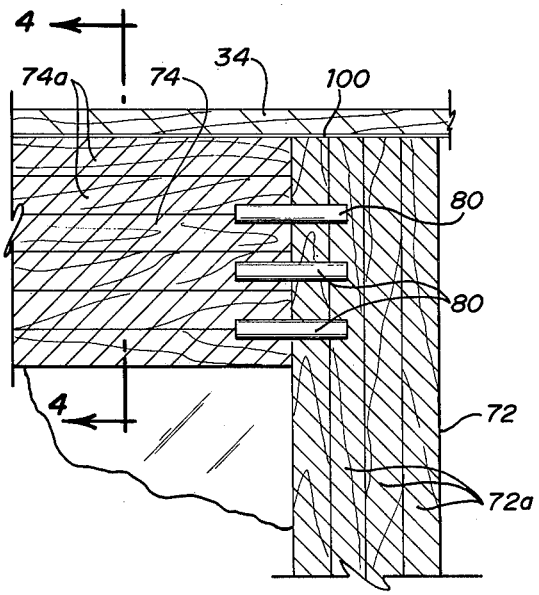
FIG. 3 is an enlarged view of the upper corner of the door unit of the present invention illustrated in FIG. 2.
Figure 4:
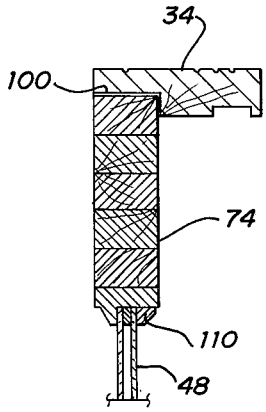
FIG. 4 is a section view taken along line 4—4 of FIG. 3 looking in the direction of the arrows.

Referring to FIGS. 3 and 4, rails 72 and 74, as well as each of the rails composing frames 40 and 44 of door panels 26 and 28, respectively, are made up of a plurality of wood strips 72*a* and 74*a* laminated or edge glued together to form the composite rail. The individual strips constituting the rails are of select wood quality, and in a preferred embodiment, are laminated one to the other by an electronic edge gluing process. In this process, a type one adhesive is applied to the surface of the strips to be joined with the surfaces being joined and the adhesive cured under controlled heat and pressure.

The construction of the rails of the frames for both door panels from high quality wood strips produces a frame structure having increased strength per unit area. This is a result of the laminant structure of the frame rails whereby weak sections of a single wood member are eliminated by the composite laminant structure. Because of this increased strength per unit area, the rails may be substantially reduced in width without decreasing the overall door panel strength. Additionally, the laminant structure limits or eliminates warping or cupping of the frame rails as a result of the composite of a plurality of strips. The reduced areas of the frame rails also results in an overall lighter door panel than in conventional wood-frame glass doors of comparable dimensions.

Referring still to FIG. 3, the upper and lower frame rails are joined to the side rails by the use of dowel pins 80 at each connection. In a preferred embodiment of the present invention, three dowel pins are used at each joint between each upper and lower rail and a side rail as illustrated in FIG. 3. However, dowel pins may be used to strengthen the joint as required. In addition, the joint is glued with a type one adhesive to add strength to the joint.

Figure 5:
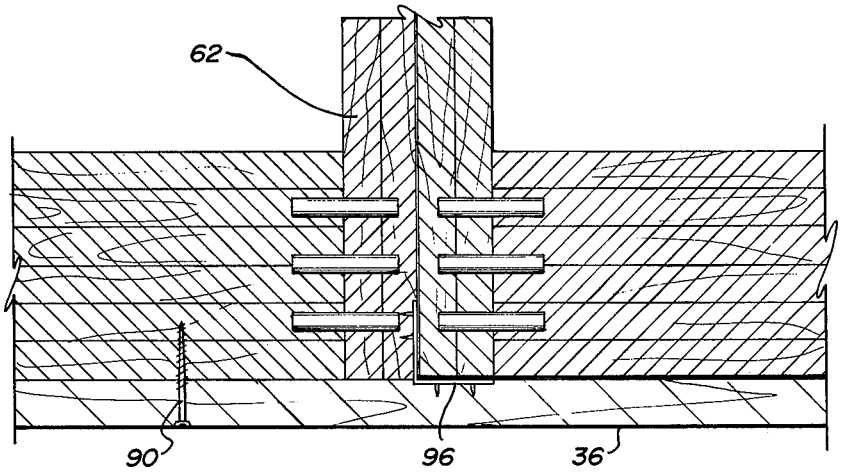
FIG. 5 is an enlarged view of the lower center portion of the door unit illustrated in FIG. 2.

Because door panel 28 is hinged from fixed door panel 26, it is imperative in the practice of the present invention that fixed door panel 26 be rigidly and properly secured to surround structure 22. This attachment of door panel 26 to surround structure 22 is illustrated in FIG. 2 in conjunction with FIG. 5. Referring to FIG. 2, a plurality of screws 90 are driven through side door jamb 30 into side rail 60 of frame 40. Similarly, a plurality of screws 90 are driven through the upper jamb and lower sill into upper and lower rails 64 and 66 of frame 40, respectively. In addition to this attachment to the surround structure 22, angle brackets 96 attach frame rail 62 to the upper jamb and lower sill 34 and 36, respectively. This connection to lower sill 36 is illustrated in FIG. 3 and in more detail in FIG. 5.

Figure 6:
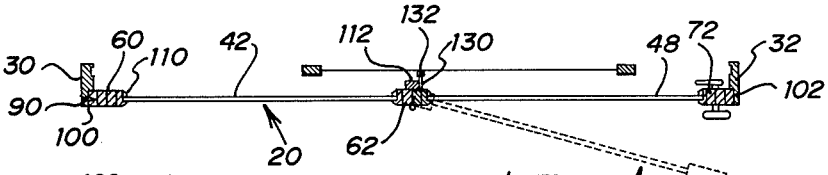
FIG. 6 is a section view taken along line 6—6 of FIG. 2 looking in the direction of the arrows.

FIG. 6 shows a sectional view taken along line 6—6 of FIG. 2 and illustrates the relation of door panels 26 and 28 to left and right door jambs 30 and 32, respectively. FIG. 6 shows the attachment of rail 60 to left door jamb 30 by screw 90. A sealant material 100, such as a butyl base bedding and sealant compound, is applied between the rail 60 and jamb 30 to effect a positive seal therebetween. A collapsible poly-flex seal 102 is fitted to right door jamb 32 and is compressed by rail 72 of frame 44 of door panel 28 as the door is moved from an open position (illustrated in dotted lines) to a closed position (illustrated in solid lines). FIG. 6 also illustrates in more detail the assembly of glass panes 42 and 48 into frames 40 and 44 of door panels 26 and 28, respectively.

The rails of the door frames are appropriately rabbitted to accept the outer dimension of glass panes 42 and 48. A sealing compound 104 is applied in the rabbitted cut and the glass pane is positioned in place. A second bead of sealing compound 104 is applied between the glass pane and rail and a retaining molding 110 is attached by staples, or other suitable means, to the frame rails to secure the glass panes therein. Glass panes 42 and 48 may be either double pane insulated or single pane glass. Where insulated glass is used, the mounting of the pane as described further assures a proper sealing of the area between the glass panes.

A mullion 112 is rigidly attached to rail 62 of frame 40 of door panel 26. Mullion 112 extends substantially the full length of rail 62 and adds substantial rigidity and support to the rail from which door panel 28 is hinged.

Figure 7:
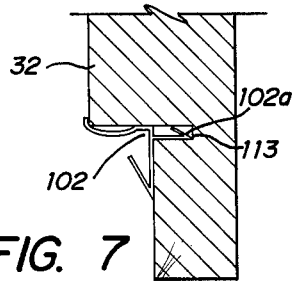
FIG. 7 is an enlarged section view taken along line 7—7 of FIG. 2 with the hingable panel shown in the open position.

FIG. 7 illustrates in more detail the weather stripping used in a preferred embodiment of the present invention. The seal illustrated is a poly-flex stripping manufactured by Schlegel Corporation, Rochester, New York. A kerf 113 is cut into door jamb 32 and receives leg 102*a* of seal 102. The seal 102 is similarly attached to upper door jamb 34 over rail 74 to effect a seal therebetween.

Figure 8:
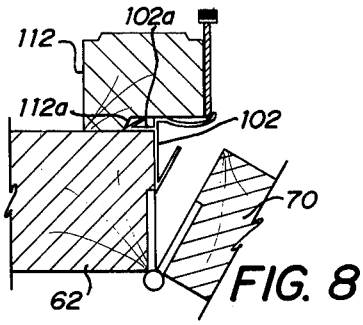
FIG. 8 is an enlarged section view taken along line 8—8 of FIG. 2 looking in the direction of the arrows.
Figure 8A:
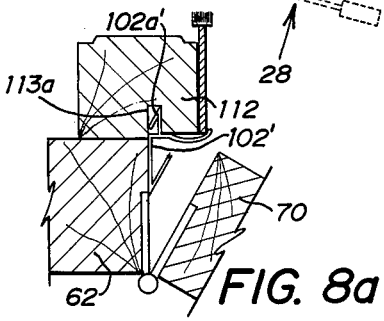
FIG. 8*a* is an enlarged section view showing an alternative embodiment of the attachment of weather stripping illustrated in FIG. 8.

FIG. 8 illustrates the attachment of seal 102 between rails 62 and 70 of door panels 26 and 28, respectively. At this location, leg 102*a* of seal 102 is received in a groove 112*a* formed between mullion 112 and rail 62 resulting from the slight rabbitting of the surface of mullion 112 adjacent rail 62. In this arrangement, seal 102 is properly positioned between rails 62 and 70 of door panels 26 and 28, respectively, such that the seal is compressed therebetween when panel 28 is closed thereby forming a positive seal. In the alternative embodiment illustrated in FIG. 8*a*, leg 102*a'* of seal 102' is received in a kerf 113*a* formed in mullion 112 such that the seal is compressed between rail 70 of door panel 28 and rail 62 when panel 28 is in the closed position. In this embodiment, the groove 112*a*, existing in the embodiment of FIG. 8, is eliminated.

Figure 9:
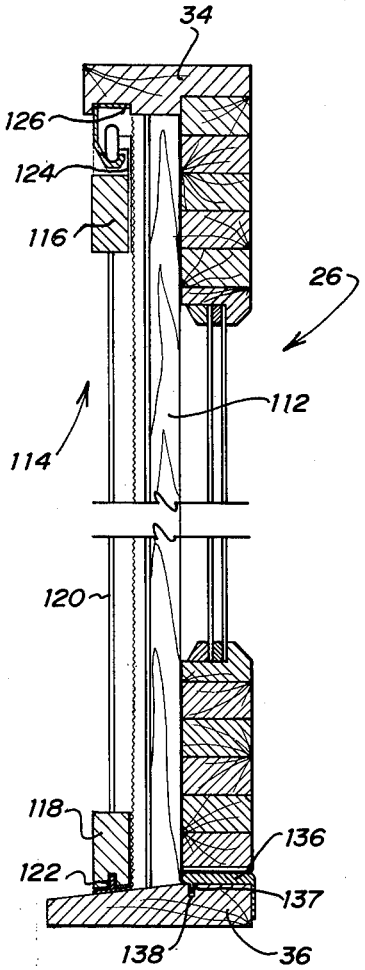
FIG. 9 is an enlarged section view taken along line 9—9 of FIG. 2 looking in the direction of the arrows.

The position of mullion 112 relative to upper door jamb 34 and lower sill 36 and door panel 26 is illustrated further by FIG. 9. FIG. 9 further illustrates the attachment of a screen 114 to the door unit 20. Screen 114 includes upper and lower frame elements 116 and 118, respectively, and a screen mesh 120 supported therebetween. Lower door sill 36 receives a T-extrusion 122 on which lower frame element 118 travels and upper frame element 116 is fitted with a roller mechanism 124 which travels on a guide 126 supported from upper door jamb 34. Referring to both FIGS. 6 and 9, a bug strip 130 is adjustable from mullion 112 and includes a brush unit 132 supported from a longitudinal base 134 attached to mullion 112. Strip 130 forms a flexible seal between mullion 112 and screen 114 while permitting the screen to slide relative to mullion 112.

FIG. 9 further illustrates the seal 136 attached to lower sill 36 which forms an insulation between panel 28 and the sill 36. Seal 136, in a preferred embodiment, is weather stripping produced by Schlegel Corporation formed with a positioning leg 137 which is received in a kerf 138 cut in sill 36. A corresponding sealing strip 139 is attached to the lower surface of rail 76 and serves to form a more positive seal between the rail and sill.

Figure 10:
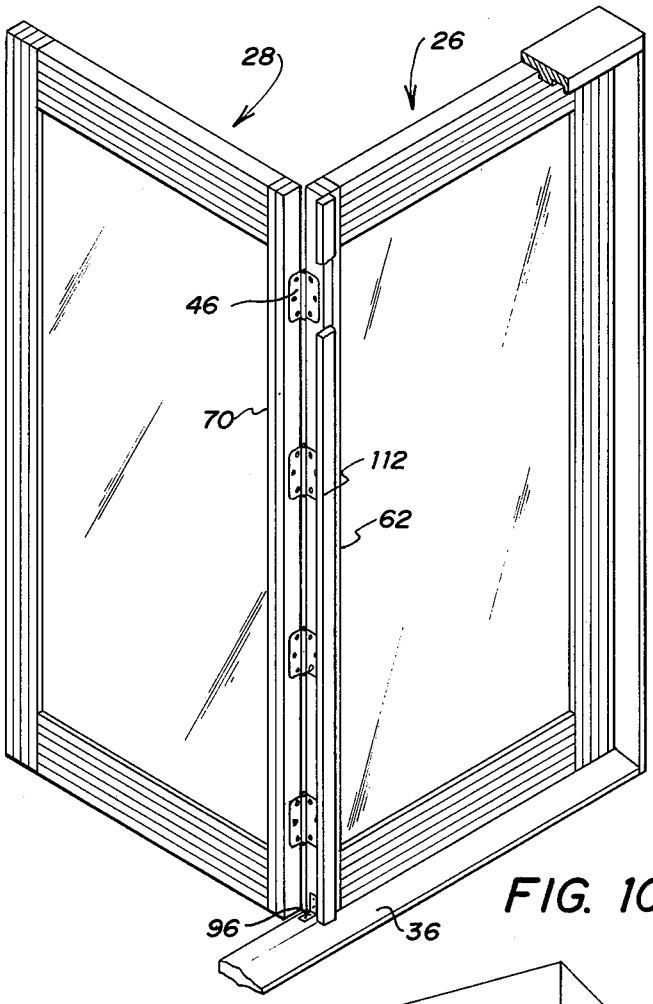
FIG. 10 is a perspective view of the invention illustrated in FIGS. 1-9 as seen from the outside with the hingable panel in the open position.

FIG. 10 is a perspective view of the door unit illustrated in FIGS. 1–9 from the outside of the structure in which the unit is installed. FIG. 10 further illustrates the attachment of hingable door panel 28 to the fixed door panel 26 by hinges 46. Mullion 112, which is attached to rail 62 of fixed door panel 26, is also more clearly illustrated. As shown in FIG. 10, four hinges are attached by a suitable means, such as screws, between the mating surfaces of rails 62 and 70 of door panels 26 and 28, respectively. Mullion 112 is fixedly attached to rail 62 in order to add support and rigidity to the rail from which door panel 28 is hinged. Mullion 112 extends beyond the edge of rail 62 in order to overlap rail 70 when door panel 28 is in the closed position. The attachment of angle bracket 96 between rail 62 and lower sill 26 is also illustrated in FIG. 10.

Thus, the present invention discloses a wood-frame glass door unit comprising at least one fixed door panel and a second door panel hinged therefrom. The frames of the door panels are composed of edge glued or laminated high quality wood strips which permit the substantial reduction of the widths of the frame rails making up the door panels. For example, the standard 6 foot, two panel wood-frame glass door units are presently constructed with a 4 9/16-inch rail width, a 13¼-inch lower rail width and 4 9/16-inch side rail widths. In contrast, the frame of the door panels of the present invention comprises a 6-inch upper and lower rail width, a 2-inch center rail width and a 4-inch rail width adjacent the side door jambs. Thus, the glass panels of the two panel unit are separated by a total of 4 inches of frame structure in the present invention whereas in the conventional wood-frame glass doors, this wood-frame dimension is 9½ inches. As a result, the glass-to-frame ratio of the present invention is substantially increased as a result of the frame structure of the present invention.

Additionally, the present invention incorporates the hinging of the operable door panel from the adjacent fixed door panel whereas conventional wood-frame glass doors are hinged from the door jamb. In this arrangement, the panel opens onto the adjacent fixed door panel and therefore does not obstruct light switches, drapery pulls, or the like mounted on the wall adjacent the door unit as is the case with conventional door units. Likewise, the wall adjacent the door unit is left open for interior decorating as desired without the obstruction of the hingable door.

Furthermore, because of the operative door panel being hinged from the adjacent fixed door panel, access to and entry and exiting through the sliding screen door is greatly facilitated. In the conventional arrangement where the door panel is hinged from the side door jamb, the operable door must be opened substantially more than in the present invention in order to enter and exit through a sliding screen door with the same facility provided by the present arrangement. Thus, a hinged screen door is often required for use with the conventional door units. The ability to hinge the hingable door panel from the fixed door panel is a result of the specific mounting used to rigidly secure and support the fixed door panel from the surround structure as is hereinabove described. It further is, at least in part, a result of the reduced frame dimensions which are accompanied by a reduction in overall weight of the door unit.

Figure 11:
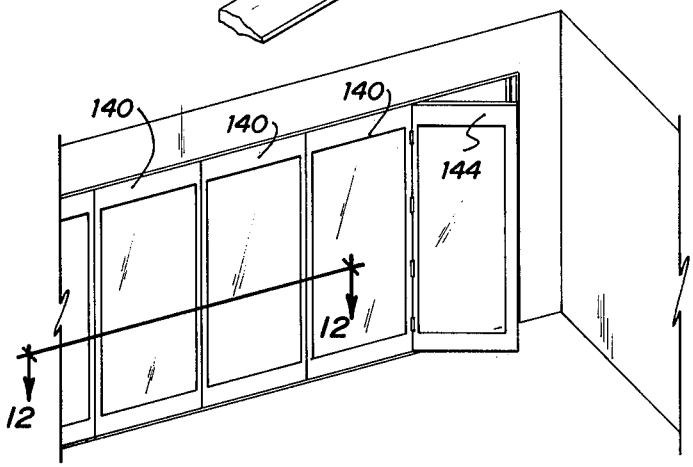
FIG. 11 shows an alternative embodiment of the present invention.
Figure 12:
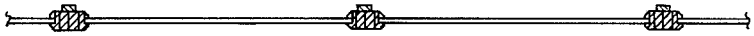
FIG. 12 is a section view taken along line 12—12 looking in the direction of the arrows.

FIGS. 11–12 illustrate an alternative embodiment of the present invention wherein a plurality of fixed panels 140 are secured to a surround structure 142 as described with respect to the embodiment illustrated in FIGS. 1–10 with the exception that a vertical mullion 148 is rigidly attached between adjacent vertical rails to add support and rigidity. A single hingable door panel 144 is hinged from the adjacent fixed door panel 140 by hinges 146. Thus, the advantages of a wood-frame glass door may be applied to create a substantial open effect by the use of door panels having a significantly increased glass-to-frame ratio by reducing the width of the frame rails as previously described in the present invention. The hingable door panel 144 is hinged from the adjacent door panel such that the door panel 144 opens onto the adjacent door panel 140 thereby leaving the wall adjacent the door unit unobstructed.

Thus, the present invention discloses an improved wood-frame glass door unit which overcomes the deficiencies heretofore experienced by prior art aluminum and wood-frame glass doors. The wood-frame glass door unit includes a wood surround structure which is attached to structure of the home or building in which the glass door is to be installed. At least two wood-frame door panels are mounted within the surround structure. Each door panel includes a frame having horizontal top and bottom rails and vertical left and right side rails. The rails are composed of edge glued or laminated wood strips formed from high quality wood stock to produce a laminant structure of higher strength than that of a single wood member. Because the laminated rails have more strength per cross-section area than a single wood member, the rails of the wood-frames of the present invention are substantially reduced in width thereby permitting a greater glass-to-frame ratio than prior art structures. Additionally, one wood-frame glass panel is rigidly mounted to the surround structure with the second panel being hinged therefrom such that the hinged door panel opens against the adjacent fixed door panel. The hinging of one door panel from the fixed panel is in part made possible by the specific mounting of the fixed door panel to the surround structure and, at least in part, by the narrower and therefore lighter weight frame resulting from the laminated structure from which the frame is constructed. This arrangement permits opening of the door against the fixed door panel thus leaving the surrounding wall free from obstruction by the hinged panel when in the open position.

Having described the invention in connection with certain specific embodiments thereof, it is to be understood that further modifications may now suggest themselves to those skilled in the art and it is intended to cover such modifications as fall within the scope of the appended claims.

What is claimed is:

1. An entrance and exit wood frame glass door unit comprising:

a wood surround structure, a first and second door panel each comprising a frame with a glass pane fitted therein, each said frame including laminated first and second side rails maintained in a spaced relation by laminated top and bottom rails attached between the first and second side rails, said lamination permitting the reduction of the width of said frame members and said first side rail of said second door panel and said second side rail of said first panel being on the order of one-half the width of said second side rail of said second panel and said first side rail of said first panel, fastener means for rigidly mounting said first door panel to said surround structure, hinge means for hingedly connecting said first side rail of said second door panel to said second side rail of said first door panel whereby said second door panel hinges against said first door panel.

2. The door unit of claim 1 further comprising:

a mullion support rigidly attached to the side rail of the frame of said first door panel adjacent said second door panel, said mullion support providing rigidity to the first door panel adjacent the point from which said second door panel is hinged.

3. The door unit of claim 1 wherein said fastener means is characterized by:

a plurality of screws for fastening said first door panel along the top and bottom rails and along said first side rail to said surround structure, and angle brackets attaching said second side rail of said first door panel to said surround structure.

4. The door unit of claim 1 wherein said surround structure includes a first and second side door jamb maintained in a spaced relation by a top door jamb and bottom sill.

5. In a wood-frame glass door unit having a surround structure and a first and second door panel each having a frame and glass pane, the combination comprising:

first and second side rails formed from a plurality of laminated wood strips for forming the sides of each frame, said side rails being formed from a plurality of laminated wood strips, top and bottom rails attached between said side rails and forming the top and bottom of each frame, said top and bottom rails being formed from a plurality of laminated wood strips, said lamination permitting the reduction of the width of each of the side, top and bottom rails thereby permitting more glass area, fastener means for rigidly securing said first door panel to said surround structure, and hinge means for hingeably connecting the first side rail of the second door panel to the second side rail of the first door panel whereby said second door panel is hinged from said first door panel.

6. The door unit of claim 5 further comprising:

a mullion support rigidly attached to the second side rail of the first door panel, said mullion support providing rigidity to the first door panel adjacent the points from which the second door panel is hinged.

7. The door unit of claim 6 further comprising:

a flexible weather strip supported between said mullion support and said second side rail of the first door panel, said weather strip being positioned between the mating faces of said second side rail of the first door panel and said first side rail of the second door panel whereby said weather strip is compressed therebetween when the second door panel is in a closed position.

8. The door unit of claim 5 wherein said fastener means is characterized by:

a plurality of screws for fastening the first door panel along said top and bottom rails and along said first side rail to the surround structure, and angle brackets attaching said second side rail of the first door panel to said surround structure.

9. A wood-frame glass door unit comprising:

a first panel wood-frame for supporting a glass pane therein, the members of said frame being composed of laminated wood strips to permit the reduction of the width of the members making up said frame, a second panel wood-frame for supporting a glass pane therein, the members of said frame being composed of laminated wood strips to permit the reduction of the width of the members making up said frame, thereby reducing the frame to glass ratio and the weight of the frame and glass combination, a surround structure, fastener means for rigidly attaching said first panel wood-frame to said surround structure, and hinge means for hinging said second panel wood-frame from said first panel frame.

10. The door unit of claim 9 further comprising:

a support member rigidly attached to said first panel frame adjacent the hinged connection of said second panel frame to said first panel frame for adding support to said first panel frame adjacent the points from which said second panel frame is hinged.

11. The door unit of claim 10 further comprising:

a flexible insulation strip supported between said mullion support and said first panel frame, said strip being positioned between the mating faces of said first panel frame and said second panel frame whereby said strip is compressed therebetween when the second panel frame is in a closed position.

12. The door unit of claim 9 wherein said fastener means comprises:

a plurality of screws passing through said surround structure and into said first panel frame, and angle brackets attached between said first panel frame and said surround structure.

13. The unit of claim 9 wherein said hinge means comprises at least four hinges.

14. A wood-frame glass door unit comprising:

a first door panel having a frame including a first and second side rail maintained in a spaced relationship by a top and bottom rail attached between the ends of the first and second side rail, a first glass pane fitted within the frame of said first door panel, a second door panel having a frame including a first and second side rail maintained in a spaced relationship by a top and bottom rail attached between the ends of the first and second side rail, a second glass pane fitted within the frame of said first door panel, a surround structure including a first and second side door jamb maintained in a spaced relationship by a top door jamb and bottom sill attached between the ends of the first and second side door jambs, fastener means for rigidly securing said first door panel to said surround structure, said fastener means including a plurality of screws for fastening said first door panel along the top rail to said top door jamb and along the bottom rail to said bottom sill and a plurality of screws for fastening said first side rail of the first door panel to said first side door jamb, said fastener means further including angle brackets attaching said second side rail of said first door panel to said top door jamb and bottom sill, and hinge means for hingeably connecting the first side rail of the second door panel to the second side rail of said first door panel whereby said second door panel is hinged from said first door panel.

15. The door unit of claim 14 further comprising:

a mullion support rigidly attached to the second side rail of said first door panel adjacent said second panel, said mullion support providing rigidity to said first door panel adjacent the points from which said second door panel is hinged.

16. The door unit of claim 15 further comprising:

a weather stripping supported between said mullion support and the second rail of said first door panel, said weather stripping being positioned between the second side rail of said first door panel and the first side rail of said second door panel whereby said weather stripping is compressed therebetween when said second door panel is in the closed position.

17. The door unit of claim 14 wherein:

the side, top and bottom rails of said first and said second door panels are formed from a plurality of laminated wood strips, said lamination permitting the reduction of the width of each of the side, top and bottom rails thereby permitting said first and second glass panes to be increased in size.

18. The door unit of claim 14 further comprising:

a screen door including a frame and screen mesh supported therein, said screen door being slidable in said surround structure from a first position adjacent said hingable second door panel to a second open position adjacent said fixed first door panel such that said sliding screen door is easily accessible through said hingable second door panel.

19. A method for making a wood-frame glass door unit comprising:

laminating wood strips edge-to-edge to permit the forming of narrow wood rails, forming the frames of at least two door panels from the laminated wood rails, each said including a first and second side rail maintained in a spaced relationship by a top and bottom rail attached between the end of the first and second side rail, inserting glass panes within the frames, forming a surround structure, rigidly fastening one of the door panels to the surround structure by attaching the first side rail and the top and bottom rail to the surround structure, and hinging the other door panel from the fixed door panel by hinging the first side rail of the other door panel to the second side rail of the one door panel.

20. The method of claim 19 wherein the fastening step comprises:

butting three sides of the frame of the fixed door panel against three corresponding sides of the surround structure, inserting a plurality of fasteners through the surround structure into the frame to secure the frame to the surround structure, and securing brackets between the inside of the surround structure and the frame of the fixed door panel.

21. The method of claim 19 further comprising: attaching a support member along the longitudinal length of the side rail of the fixed door panel adjacent the hinged door panel to add rigidity to the frame structure.

* * * * *